US008512051B2

(12) United States Patent
Chiu et al.

(10) Patent No.: US 8,512,051 B2
(45) Date of Patent: Aug. 20, 2013

(54) CONNECTOR CONVERTING DEVICE

(75) Inventors: Po-Wen Chiu, New Taipei (TW); Wen-Hu Lu, Shenzhen (CN); Zhan-Yang Li, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 78 days.

(21) Appl. No.: 13/245,851

(22) Filed: Sep. 26, 2011

(65) Prior Publication Data

US 2012/0231670 A1 Sep. 13, 2012

(30) Foreign Application Priority Data

Mar. 9, 2011 (CN) ..... 2011 1 0055231

(51) Int. Cl.
*H01R 12/00* (2006.01)

(52) U.S. Cl.
USPC ..... 439/76.1

(58) Field of Classification Search
USPC ..... 439/76.1, 638, 439
See application file for complete search history.

(56) References Cited

U.S. PATENT DOCUMENTS

| | | | | |
|---|---|---|---|---|
| 5,507,668 | A * | 4/1996 | Lambrinos et al. | 439/502 |
| 5,816,861 | A * | 10/1998 | Cheng | 439/653 |
| 6,050,831 | A * | 4/2000 | Wu et al. | 439/76.1 |
| 6,241,534 | B1 * | 6/2001 | Neer et al. | 439/76.1 |
| 8,096,837 | B2 * | 1/2012 | Kan et al. | 439/638 |

* cited by examiner

*Primary Examiner* — Phuong Dinh
(74) *Attorney, Agent, or Firm* — Altis Law Group, Inc.

(57) ABSTRACT

A connector converting device includes a mounting member, a circuit board, and a cover member. A receiving space, a front opening, and a rear opening are defined in the mounting member. The circuit board includes a board body, a first socket extending from the board body, and a first connecting end. The board body is received in the receiving space. The first connecting end extends out of the mounting member via the front opening to electrically connect to a second socket. The first socket electrically connects to a cable via the rear opening. The cover member engages with the mounting member to secure board body to the mounting member.

17 Claims, 5 Drawing Sheets

CONNECTOR CONVERTING DEVICE

BACKGROUND

1. Technical Field

The disclosure generally relates to converting devices, especially, to an connector converting device.

2. Description of Related Art

A male connector and a female connector are generally employed to transmit signals between two electronic components. Sometimes, it is difficult to couple the male connector with the female connector if the male connector is flat.

Thus, there is room for improvement within the art.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
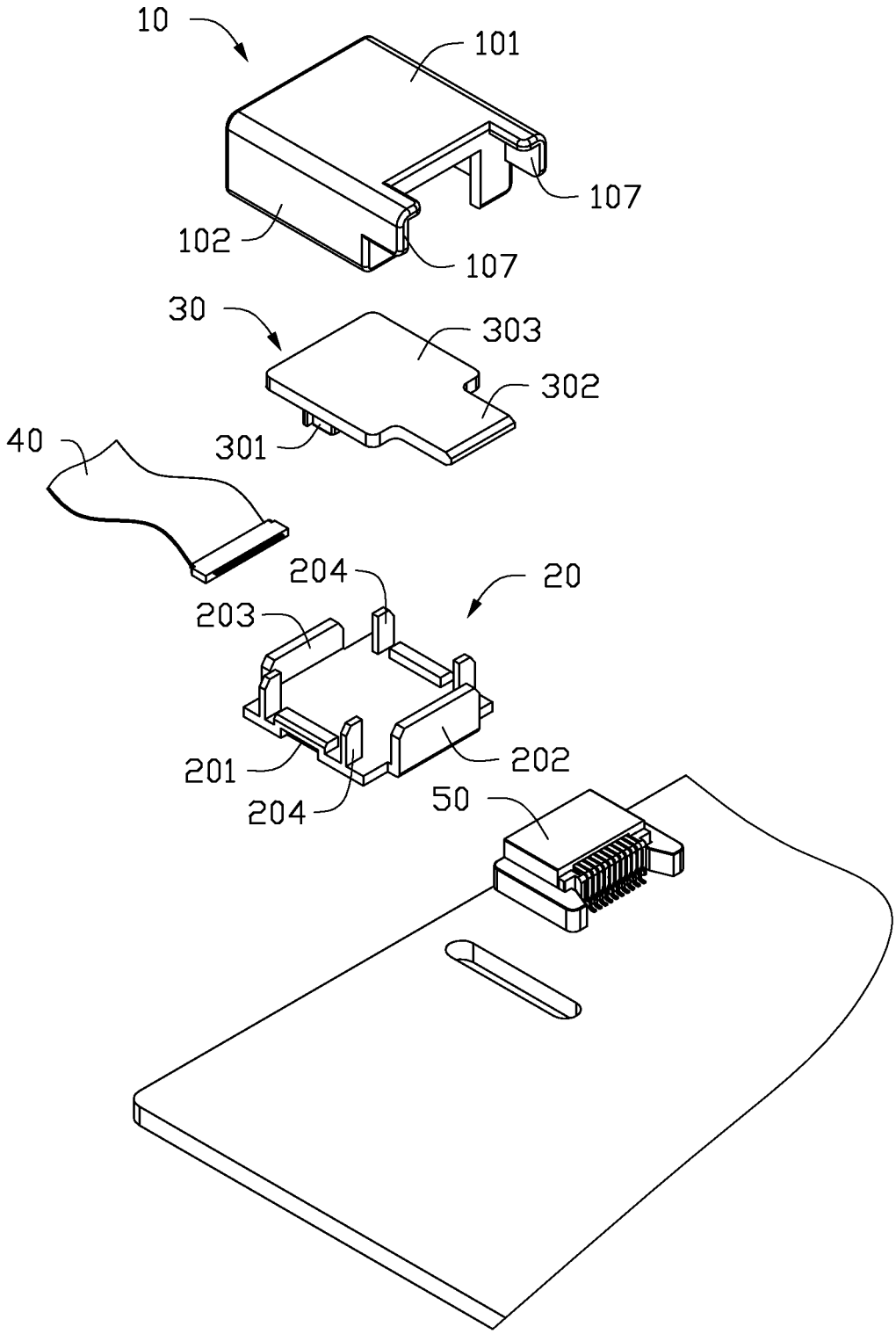
FIG. 1 is an exploded, isometric view of an embodiment of an electronic device.
Figure 2:
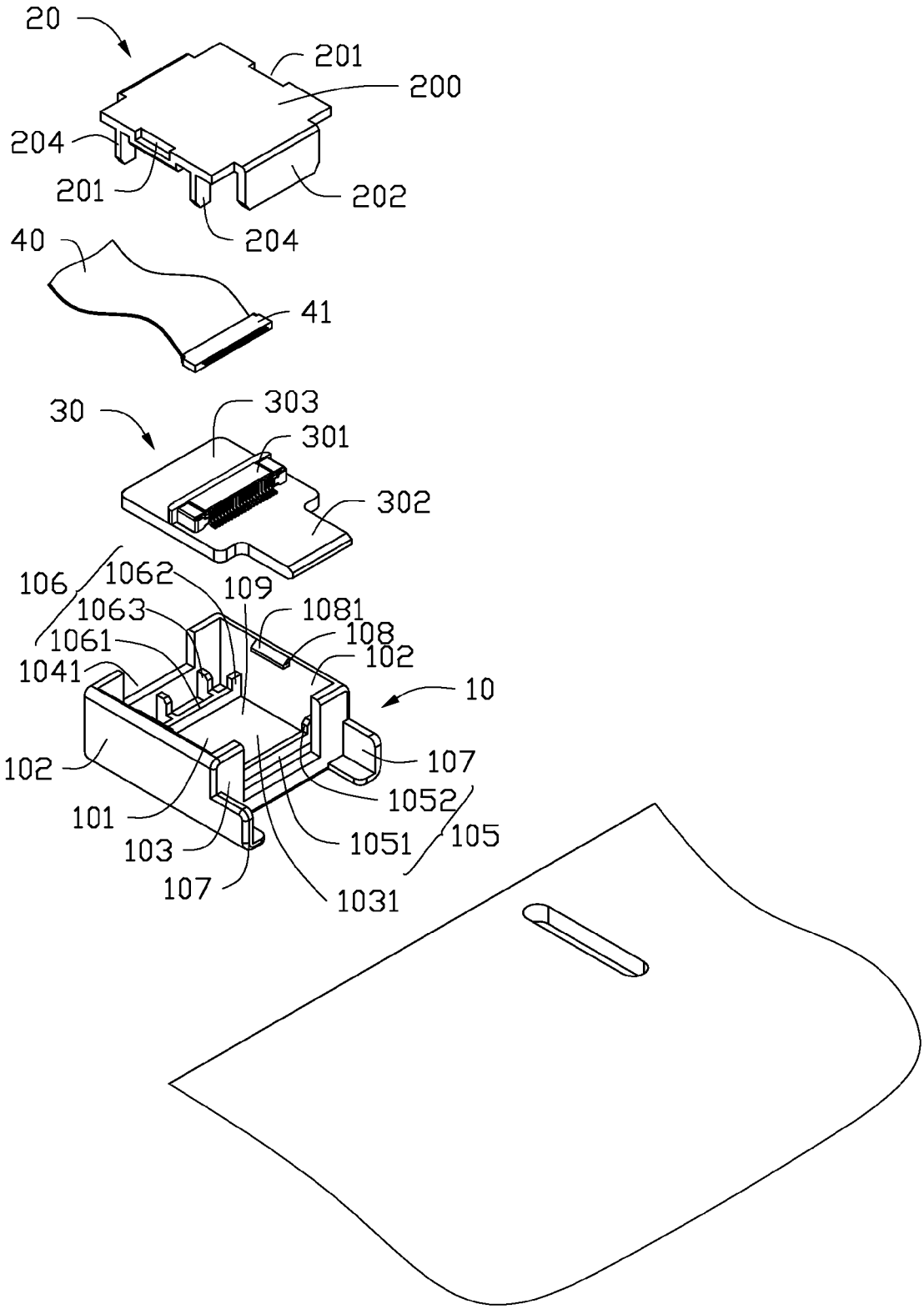
FIG. 2 is similar to FIG. 1, but viewed from another aspect.

Referring to FIGS. 1 and 2, one embodiment of a connector converting device is shown. The connector converting device is used for connecting a cable 40 to a second socket 50. The connector converting device includes a mounting member 10, a cover member 20, and a circuit board 30.

The circuit board 30 includes a board body 303, a first socket 301 mounted on the board body 303, and a first connecting end 302 extending from the board body 303. The cable 40 includes a second connecting end 41. The second connecting end 41 is used to electrically connect to the first socket 301. The first connecting end 302 is used to electrically connect to and be received in the second socket 50.

The mounting member 10 includes a bottom panel 101, two parallel side panels 102 extending substantially perpendicularly from the bottom panel 101, a front panel 103, and a rear panel 104. A front opening 1031 is defined in the front panel 103 and a rear opening 1041 is defined in the rear panel 104. The mounting member 10 includes a first positioning portion 105 and a second positioning portion 106 extending from the bottom panel 101. The first positioning portion 105 includes a first body 1051 and two first positioning protrusions 1052 extending from opposite sides of the first body 1051. The second positioning portion 106 includes a second body 1061, two second positioning protrusions 1062, and two resisting portions 1063 extending from the second body 1061. The mounting member 10 further includes two guiding portions 107 extending from the two side panels 102. Each guiding portion 107 can be L-shaped. A receiving space 109 is surrounded by the two side panels 102, the front panel 103, and the rear panel 104. The mounting member 10 includes a securing protrusion 108 extending from each side panel 102. The securing protrusion 108 can be triangle edge-shaped. The securing protrusion 108 includes an inclining surface 1081.

The cover member 20 includes a base panel 200, a front tab 202, a rear tab 203, and a plurality of supporting posts 204 extending from the base panel 200. The base panel 200 can define two L-shaped recesses 201 corresponding to the securing protrusions 108.

Figure 3:
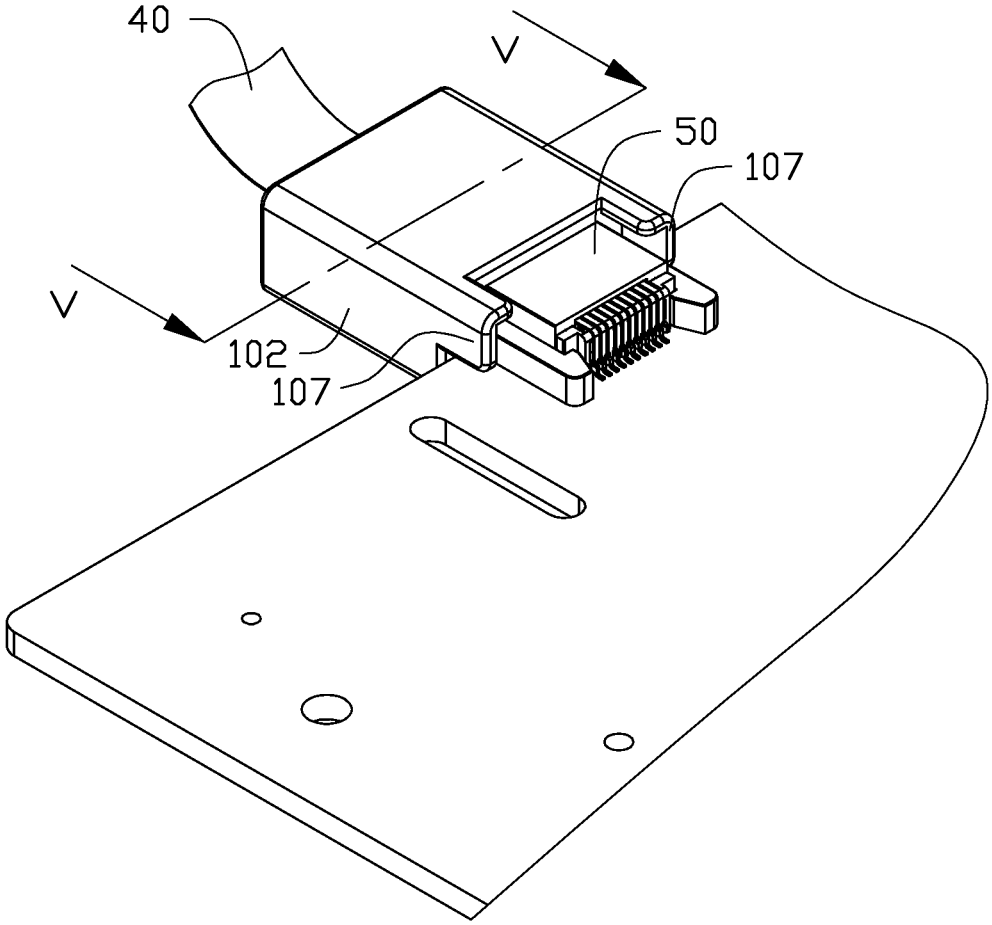
FIG. 3 is an assembled view of FIG. 1.
Figure 4:
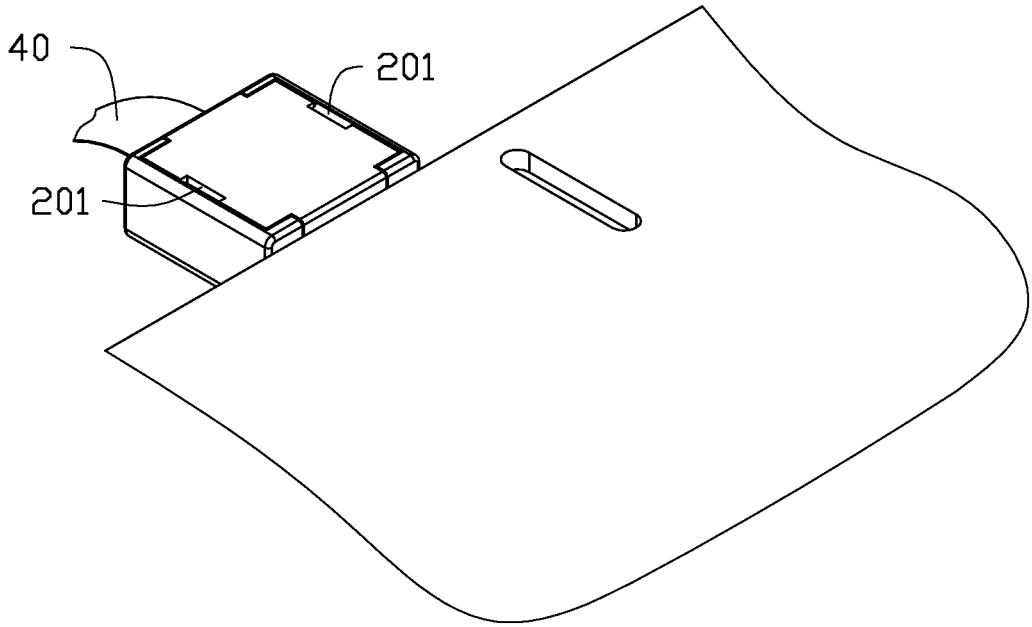
FIG. 4 is an assembled view of FIG. 1, but viewed from another aspect.
Figure 5:
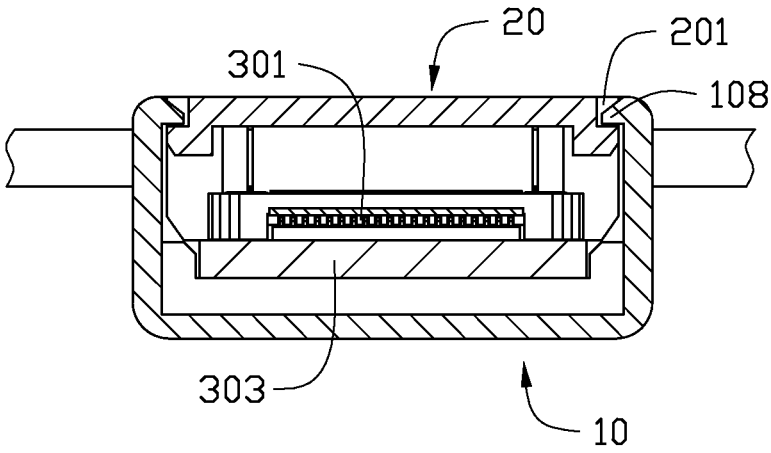
FIG. 5 is a cross section view of FIG. 3, taken along lines V-V.

Referring to FIGS. 3 to 5, in assembly, the first socket 301 of the circuit board 30 is connected to the cable 40. The circuit board 30 is then placed in the receiving space 109. The board body 303 is disposed on the second body 1061 of the second positioning portion 106 and the first connecting end 302 is disposed on the first body 1051. At this time, the first connecting end 302 is disposed between the first positioning protrusions 1052 to prevent movement along a first direction substantially perpendicular to the side panel 102. The board body 303 is disposed between the second positioning protrusions 1062 to prevent movement along the first direction. The board body 303 is disposed between the resisting portions 1063 and the first positioning protrusions 1052 to prevent movement along a second direction substantially perpendicular to the first direction. The first connecting end 302 is disposed in the front opening 1031. The cover member 20 is moved near the mounting member 10. The base panel 200 of the cover member 20 moves along the inclining surface 1081 when contacting the securing protrusions 108. The securing protrusions 108 engage with the recesses 201 to prevent the circuit board 30 from moving in a direction substantially perpendicular to the board body 303, thereby securing the cover member 20 to the mounting member 10. At this time, the supporting posts 204 are contacting the board body 303. The front tab 202 covers the front opening 1031 and the rear tab 203 covers the rear opening 1041. The guiding portions 107 then slides along an outer surface of the second socket 50 in a direction substantially parallel to the board body 303 to guide the first connecting end 302 into the second socket 50.

It is to be understood, however, that even though numerous characteristics and advantages have been set forth in the foregoing description of embodiments, together with details of the structures and functions of the embodiments, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A connector converting device, comprising:

a mounting member defining a receiving space, a front opening, and a rear opening ;

a circuit board comprising a board body, a first socket extending from the board body, and a first connecting end, the board body being received in the receiving space, the first connecting end extending out of the mounting member via the front opening for electrically connecting to a second socket, the first socket being adapted to electrically connect to a cable via the rear opening; and a cover member engaging with the mounting member to secure the board body to the mounting member;

wherein the mounting member comprises a bottom panel, two side panels, a front panel, and a rear panel; the two side panels extend from the bottom panel and are substantially parallel to each other; the rear panel and the front panel extend from the bottom panel and are connected between the two side panels; the front opening is defined in the front panel and the rear opening is defined in the rear panel; the receiving space is surrounded by the side panels, the front panel, and the rear panel; and the mounting member further comprises an L-shaped guiding portion extending from each side panel for guiding the first connecting end to the second socket.

2. The connector converting device of claim 1, wherein the mounting member further comprises a first positioning portion and a second positioning portion extending from the bottom panel, and the first connecting end is disposed on the first positioning portion and the board body is disposed on the second positioning portion.

3. The connector converting device of claim 2, wherein the first positioning portion comprises a first body and two positioning protrusions extending from opposite sides of the first body, and the first connecting end is disposed on the first body and between the two first positioning protrusions to prevent movement in a first direction.

4. The connector converting device of claim 3, wherein the second positioning portion comprises a second body and two second positioning protrusions extending from opposite sides of the second body, and the board body is disposed on the second body and between the two second positioning protrusions to prevent movement in the first direction.

5. The connector converting device of claim 4, wherein the second positioning portion further comprises a resisting portion extending from the second body, and the board body is disposed between the resisting portion and the first positioning protrusions to prevent movement in a second direction substantially perpendicular to the first direction.

6. The connector converting device of claim 1, wherein the mounting member further comprises a securing protrusion extending from each side panel, and the cover member defines two recesses engaging with the securing protrusions; each securing protrusion is triangle edge-shaped; and each securing protrusion includes an inclining surface to guide the recess to engage with the securing protrusion.

7. The connector converting device of claim 1, wherein the cover member comprises a base panel and a plurality of supporting posts extending from the base panel, and the supporting posts resist between the board body and the base panel.

8. The connector converting device of claim 1, wherein the cover member comprises a base panel, a front tab extending from the base panel, and a rear tab extending from the base panel, the front tab covers the front opening, and the rear tab covers the rear opening.

9. A connector converting device, comprising:

a mounting member defining a receiving space;

a circuit board comprising a board body, a first socket extending from the board body, and a first connecting end, the board body being received in the receiving space, the first socket being adapted to electrically connect to a cable, the first connecting end being exposed out of the mounting member, the first connecting end being adapted to electrically connect to a second socket in a first direction substantially parallel to the board body; and a cover member engaging with the mounting member to prevent the circuit board from moving in a second direction substantially perpendicular to the first direction, and to cover the first socket to prevent the first socket from being exposed out of the mounting member.

10. The connector converting device of claim 9, wherein the mounting member comprises a bottom panel, two side panels, a front panel, and a rear panel; the two side panels extend from the bottom panel and are substantially parallel to each other, the rear panel and the front panel extend from the bottom panel and are connected between the two side panels; and the receiving space is surrounded by the side panels, the front panel, and the rear panel.

11. The connector converting device of claim 10, wherein the mounting member further comprises a first positioning portion and a second positioning portion extending from the bottom panel, and the first connecting end is disposed on the first positioning portion and the board body is disposed on the second positioning portion.

12. The connector converting device of claim 11, wherein the first positioning portion comprises a first body and two positioning protrusions extending from opposite sides of the first body, the first connecting end is disposed on the first body and between the two first positioning protrusions to prevent movement in a third direction substantially perpendicular to the side panel.

13. The connector converting device of claim 12, wherein the second positioning portion comprises a second body and two second positioning protrusions extending from opposite sides of the second body, and the board body disposed on the second body between the two second positioning protrusions to prevent movement in the third direction.

14. The connector converting device of claim 13, wherein the second positioning portion further comprises a resisting portion extending from the second body, and the board body is disposed between the resisting portion and the first positioning protrusions to prevent movement in a fourth direction substantially perpendicular to the third direction.

15. The connector converting device of claim 10, wherein the mounting member further comprises a securing protrusion extending from each side panel, and the cover member defines two recesses engaging with the securing protrusions; each securing protrusion is triangle edge-shaped; and each securing protrusion includes an inclining surface to guide the recess to engage with the securing protrusion.

16. The connector converting device of claim 10, wherein the mounting member further comprises an L-shaped guiding portion extending from each side panel for guiding the first connecting end to move to the second socket in the first direction.

17. The connector converting device of claim 9, wherein the cover member comprises a base panel and a plurality of supporting posts extending from the base panel, and the supporting posts resist between the board body and the base panel.

* * * * *